US011428013B2

(12) United States Patent
Tatsuki

(10) Patent No.: US 11,428,013 B2
(45) Date of Patent: Aug. 30, 2022

(54) MOUNTING MEMBER AND BUILDING WALL STRUCTURE

(71) Applicant: NICHIHA CORPORATION, Nagoya (JP)

(72) Inventor: Ryohei Tatsuki, Nagoya (JP)

(73) Assignee: NICHIHA CORPORATION, Nagoya (JP)

( * ) Notice: Subject to any disclaimer, the term of this patent is extended or adjusted under 35 U.S.C. 154(b) by 0 days.

(21) Appl. No.: 16/824,973

(22) Filed: Mar. 20, 2020

(65) Prior Publication Data

US 2020/0217081 A1 Jul. 9, 2020

Related U.S. Application Data

(63) Continuation of application No. PCT/JP2018/033789, filed on Sep. 12, 2018.

(30) Foreign Application Priority Data

Sep. 29, 2017 (JP) ..... JP2017-191184

(51) Int. Cl.
*E04F 13/08* (2006.01)
*E04F 13/21* (2006.01)
*E04F 13/22* (2006.01)

(52) U.S. Cl.
CPC ..... *E04F 13/0828* (2013.01); *E04F 13/22* (2013.01); *E04F 13/08* (2013.01); *E04F 13/0832* (2013.01); *E04F 13/21* (2013.01)

(58) Field of Classification Search
CPC ... E04F 13/0828; E04F 13/08; E04F 13/0832; E04F 13/072; E04F 13/0835;
(Continued)

(56) References Cited

U.S. PATENT DOCUMENTS 499,814 A 6/1893 Williams
2,645,824 A * 7/1953 Titsworth ..... E04B 1/7069 52/302.3
(Continued)

FOREIGN PATENT DOCUMENTS

AU 2018343781 A1 3/2020
EP 3 578 732 A1 12/2019
(Continued)

OTHER PUBLICATIONS

International Search Report, issued in PCT/JP2018/033789, dated Nov. 27, 2018.
(Continued)

*Primary Examiner* — Phi D A
(74) *Attorney, Agent, or Firm* — Birch, Stewart, Kolach & Birch, LLP

(57) ABSTRACT

Provided are a mounting member and a building wall structure that allow a mounting operation to be performed with ease. A mounting member 10 can be equipped with an abutment member 30. The mounting member 10 includes a substrate portion 11, a wall portion 12, a protruding portion 13, a supporting portion 14, a first locking portion 15, and a second locking portion 16. The wall portion 12 protrudes from one side edge 11A of the substrate portion 11 relative to the substrate portion 11. The protruding portion 13 protrudes from the other side edge 11B side of the substrate portion 11 to the same side as the wall portion 12, and has a length L13 of protrusion from the substrate portion 11 shorter than the length of protrusion of the wall portion 12 from the substrate portion 11. The abutment member 30 includes a mounting portion 31 that can be fixed onto at least one of the substrate portion 11 and substantially the same plane 8P as the substrate portion 11 from the protruding portion 13 side, an erect piece 32 that is provided erecting in a direction intersecting the mounting portion 31, and that
(Continued)

protrudes toward the side opposite to the substrate portion 11, and a clamping portion 33 that is formed as a single piece with the mounting portion 31, and that is capable of clamping the protruding portion 13 from a direction intersecting the substrate portion 11.

6 Claims, 12 Drawing Sheets

(58) Field of Classification Search
CPC ..... E04F 13/21; E04F 13/22; E04F 13/0801; E04F 13/0846
See application file for complete search history.

(56) References Cited

U.S. PATENT DOCUMENTS 2,924,963 A * 2/1960 Taylor ..... E04F 13/0846 52/509
3,342,005 A * 9/1967 Rickards ..... E04F 13/0846 52/702
3,412,515 A * 11/1968 Finon ..... E04F 13/0821 52/480
3,477,187 A * 11/1969 Fruman ..... E04F 13/0803 52/346
4,102,106 A * 7/1978 Golder ..... E04F 13/0864 52/533
4,156,993 A * 6/1979 Sorrells, Jr. ..... E04D 13/1415 52/60
4,641,473 A * 2/1987 Trezza ..... E04F 13/0846 52/410
5,228,937 A * 7/1993 Passeno ..... E04F 13/0801 156/297
D353,128 S * 12/1994 Christensen ..... D12/412
5,390,457 A * 2/1995 Sjolander ..... E04F 13/0803 52/387
6,289,644 B1 * 9/2001 Gerhaher ..... E04F 13/0826 52/235
7,152,836 B2 * 12/2006 Pfister ..... F16C 11/103 248/292.14
8,127,507 B1 * 3/2012 Bilge ..... E04F 13/0823 52/235
9,021,767 B1 * 5/2015 Barrett, Jr. ..... E04F 13/147 52/747.1
D766,465 S * 9/2016 Honda ..... E04F 3/0826 D25/119
D767,382 S * 9/2016 Libreiro ..... D8/382
D775,516 S * 1/2017 Honda ..... E04F 3/0826 D8/382
D809,675 S * 2/2018 Singh ..... D25/119
10,844,608 B2 * 11/2020 Ausseur ..... E04F 13/0835
10,907,361 B2 * 2/2021 Sawada ..... E04F 13/08
2002/0032999 A1 * 3/2002 Ito ..... E04F 13/0803 52/474
2002/0046546 A1 * 4/2002 Ito ..... E04F 13/0846 52/802.11
2002/0095889 A1 * 7/2002 Hikai ..... E04F 13/0826 52/235
2005/0102944 A1 * 5/2005 Hikai ..... E04F 13/0846 52/511
2006/0032173 A1 * 2/2006 Hikai ..... E04F 13/0826 52/506.05
2010/0122506 A1 * 5/2010 Kato ..... E04F 13/0846 52/483.1
2013/0000238 A1 * 1/2013 Minami ..... E04F 13/0826 52/483.1
2013/0205698 A1 * 8/2013 Todd ..... E04F 13/083 52/302.1
2015/0292214 A1 * 10/2015 Maurer ..... E04F 13/185 52/547
2015/0345152 A1 * 12/2015 Libreiro ..... E04F 13/0891 52/506.05
2017/0226732 A1 * 8/2017 Collins ..... E04B 1/765
2017/0321732 A1 * 11/2017 de Goeij ..... F16B 5/0642
2018/0016797 A1 * 1/2018 Suzuki ..... E04F 13/0828
2018/0171640 A1 * 6/2018 Heidtmann ..... E04F 13/0828
2018/0334809 A1 * 11/2018 Smart ..... E04F 13/0846
2021/0085101 A1 * 3/2021 Thrush ..... F16M 13/022

FOREIGN PATENT DOCUMENTS

JP 2-96048 A 4/1990
JP 7-18817 A 1/1995
JP 7-26688 A 1/1995
JP 10-110515 A 4/1998
JP 11-311009 A 11/1999
JP 11-336288 A 12/1999
JP 2000-87529 A 3/2000
JP 2001-90308 A 4/2001
JP 2002-138647 A 5/2002
JP 2003-74167 A 3/2003
JP 2003-129638 A 5/2003
JP 2004-270341 A 9/2004
JP 2004-332450 A 11/2004
JP 2005-282198 A 10/2005
JP 2007-162352 A 6/2007
JP D1415995 S 6/2011
JP 2013-11056 A 1/2013
JP 2014-1535 A 1/2014
JP D1504774 S 8/2014
JP D1505126 S 8/2014
JP D1506336 S 9/2014
JP 2015-74947 A 4/2015
JP 2015-194036 A 11/2015
JP 2016-102361 A 6/2016
JP 2017-2461 A 1/2017
JP 2019-11593 A 1/2019
WO WO 2011/040515 A 4/2011
WO WO 2019/004143 A1 1/2019
WO WO 2019/065238 A1 4/2019

OTHER PUBLICATIONS

European Patent Office Communication and Search Report issued in the corresponding European Patent Application No. 18860594.3 dated May 27, 2021.
Chinese Office Action and Search Report, dated Mar. 3, 2021, for Chinese Application No. 201880052217.3, with an English translation of the Chinese Office Action.
Japanese History Records for Japanese Application No. 2017-191184, dated Nov. 2, 2021, with an English translation.
Japanese Notice of Reasons for Refusal for Japanese Application No. 2017-191184, dated Nov. 2, 2021, with an English translation.

* cited by examiner

MOUNTING MEMBER AND BUILDING WALL STRUCTURE

CROSS REFERENCE TO RELATED APPLICATIONS

This application is a Continuation of PCT International Application No. PCT/JP2018/033789, filed on Sep. 12, 2018, which claims priority under 35 U.S.C. 119(a) to Patent Application No. 2017-191184, filed in Japan on Sep. 29, 2017, all of which are hereby expressly incorporated by reference into the present application.

TECHNICAL FIELD

The present invention relates to a wall-material mounting member and a building wall structure.

BACKGROUND ART

Patent Documents 1 to 3 disclose examples of a conventional mounting member for mounting a wall material. The mounting member (fastening fitting) disclosed in Patent Document 1 has a shape with a substantially C-shaped cross section, and includes a first side wall portion protruding from an upper edge of a substrate portion to the substrate portion, and a first abutting portion that is bent downward from a leading edge of the first side wall portion.

The mounting member (first fastening fitting) disclosed in Patent Document 2 can be equipped with an abutment member (lateral displacement prevention fitting) for preventing lateral displacement of a wall material (exterior wall plate). In the case of this mounting member, an upper horizontal portion is connected to a flat plate portion via an upper erect portion, and protrudes upward. The abutment member is temporarily mounted to the mounting member as a result of the upper horizontal portion being clamped by a backside locking piece and a lower fixing plate.

The mounting member (fastening jig body) disclosed in Patent Document 3 can be equipped with an abutment member (horizontal spacing plate). In the case of this mounting member, a fixing surface plate is formed on the backing member side with a step provided between a substrate portion (back plate) and the fixing surface plate. The abutment member is fixed to the fixing surface plate using a tapping screw.

CITATION LIST

Patent Documents

Patent Document 1: JP 2015-74947A
Patent Document 2: JP 2013-11056A
Patent Document 3: JP 2003-74167A

SUMMARY OF INVENTION

Technical Problem

However, in the case of the mounting member described in Patent Document 1, no abutment member is disclosed.

In the case of the mounting member described in Patent Document 2, the abutment member is moved in a direction in which the abutment member approaches the structural body so as to be located at a position higher than the upper horizontal portion, and thereafter the abutment member is moved downward so as to clamp the lower fixing plate.

Accordingly, the abutment member needs to be sandwiched on the backside of the mounting member, thus making a mounting operation troublesome.

Furthermore, the mounting member described in Patent Document 3 has a configuration in which a fixing surface plate is used, and the abutment member is fixed to the fixing surface plate using a tapping screw without being temporarily mounted, and therefore, there is the possibility that the abutment member will fall off during a mounting operation. Accordingly, it is difficult to perform a mounting operations with ease and safely.

The present invention has been made in view of the above-described conventional circumstances, and it is an object of the invention to provide a mounting member and a building wall structure that allow mounting operations to be performed with ease.

Solution to Problem

A mounting member according to a first aspect of the present invention is a mounting member that can be equipped with an abutment member, and that is used for mounting a wall material to a structural body, the mounting member including:

a substrate portion that can be fixed to the structural body;

a wall portion that protrudes from one side edge of the substrate portion relative to the substrate portion;

a protruding portion that protrudes from another side edge side of the substrate portion to the same side as the wall portion, and that has a length of protrusion from the substrate portion shorter than a length of protrusion of the wall portion from the substrate portion;

a supporting portion that approaches the protruding portion by extending from a leading edge of the wall portion so as to be opposed to the substrate portion;

a first locking portion that protrudes from the supporting portion toward a side opposite to the substrate portion, and that is bent to the wall portion side; and a second locking portion that protrudes from the supporting portion toward the side opposite to the substrate portion, and that is bent to the protruding portion side, wherein the abutment member includes a mounting portion that can be fixed onto at least one of the substrate portion and substantially the same plane as the substrate portion from the protruding portion side, an erect piece that is provided erecting in a direction intersecting the mounting portion, and that protrudes toward the side opposite to the substrate portion, and a clamping portion that is formed as a single piece with the mounting portion, and that is capable of clamping the protruding portion from a direction intersecting the substrate portion.

With the mounting member according to the first aspect, the protruding portion of the mounting member can be clamped by the clamping portion simply by moving the abutment member in a direction intersecting the substrate portion. That is, the abutment member can be moved from the outdoor side and easily temporarily mounted to the protruding portion of the mounting member, and the mounting portion of the temporarily mounted abutment member can be fixed using, for example, a fastening member such as a screw, onto at least one of the substrate portion and substantially the same plane as the substrate portion.

Accordingly, the mounting member according to the first aspect of the present invention allows a mounting operation to be performed with ease.

According to a second aspect of the present invention, it is preferable that the clamping portion includes a first clamping portion that is formed as a single piece with the mounting portion, and that can be abutted against the protruding portion, a second clamping portion that is capable of clamping, together with the first clamping portion, the protruding portion with a gap substantially equal to a plate thickness of the protruding portion provided between the first clamping portion and the second clamping portion, and a plate portion that connects the first clamping portion and the second clamping portion on a side opposite to the mounting portion, and that extends so as to be spaced apart from the mounting portion.

In this case, the first and second clamping portions and the plate portion can be easily formed, for example, by bending a sheet metal. Also, the protruding portion can be reliably clamped by the first and second clamping portions while a worker is holding the plate portion.

According to a third aspect of the present invention, it is preferable that the wall portion has a through hole.

In this case, ventilation can be ensured in the surrounding region of the mounting member by the space between the back surface of the wall material and the substrate portion, and the through hole. Also, rainwater or the like that has reached the wall portion is allowed to flow downward through the through hole. As a result, it is possible to suppress a reduction in strength and durability of the wall material and the structural body.

According to a fourth aspect of the present invention, it is preferable that the wall portion is inclined so as to be spaced apart from the protruding portion in a direction from the substrate portion side toward the supporting portion side.

In this case, rainwater or the like that has reached the wall portion is allowed to flow in a direction away from the structural body due to the incline. In particular, when the wall portion has a through hole, rainwater or the like that has flown in a direction away from the structural body is allowed to flow downward through the through hole. As a result, it is possible to suppress a reduction in strength and durability of the wall material and the structural body.

According to a fifth aspect of the present invention, it is preferable that the mounting portion of the abutment member has a fixing hole for fixing the mounting portion onto at least one of the substrate portion and substantially the same plane as the substrate portion, using a fastening member. It is preferable that the substrate portion includes a recess that is recessed to a side opposite to the supporting portion, and that extends parallel to the other side edge of the substrate portion. Also, it is preferable that the recess is disposed so as to pass through a center of the fixing hole in a state in which the clamping portion clamps the protruding portion and the mounting portion is opposed to the substrate portion.

In this case, a tapered leading end of the fastening member such as a screw that is inserted into the fixing hole is caught on the recess, and, thus, positional displacement of the fastening member relative to the fixing hole can be suppressed. As a result, the mounting operations can be performed more easily.

A building wall structure according to a sixth aspect of the present invention is a wall structure to which a wall material is mounted to a structural body using a mounting member that can be equipped with an abutment member, wherein the mounting member includes a substrate portion that can be fixed to the structural body;

a wall portion that protrudes from one side edge of the substrate portion relative to the substrate portion;

a protruding portion that protrudes from another side edge side of the substrate portion to the same side as the wall portion, and that has a length of protrusion from the substrate portion shorter than a length of protrusion of the wall portion from the substrate portion;

a supporting portion that approaches the protruding portion by extending from a leading edge of the wall portion so as to be opposed to the substrate portion, and that is capable of supporting a back surface of the wall material;

a first locking portion that protrudes from the supporting portion toward a side opposite to the substrate portion, that is bent to the wall portion side, and that is capable of locking one end portion of the wall material; and a second locking portion that protrudes from the supporting portion toward the side opposite to the substrate portion, that is bent to the protruding portion side, and that is capable of locking another end portion of the wall material, and the abutment member includes a mounting portion that can be fixed onto at least one of the substrate portion and substantially the same plane as the substrate portion from the protruding portion side, an erect piece that is provided erecting in a direction intersecting the mounting portion, that protrudes toward the side opposite to the substrate portion, and that can be abutted against a side end portion of the wall material, and a clamping portion that is formed as a single piece with the mounting portion, and that is capable of clamping the protruding portion from a direction intersecting the substrate portion.

The building wall structure according to the sixth aspect of the present invention allows a mounting operation to be performed with ease due to the effect achieved by the mounting member according to the first aspect.

A mounting member according to a seventh aspect of the present invention is a mounting member for mounting a wall material to a structural body, the mounting member including:

a substrate portion that can be fixed to the structural body;

a wall portion that protrudes from one side edge of the substrate portion relative to the substrate portion;

a protruding portion that protrudes from another side edge side of the substrate portion to the same side as the wall portion, and that has a length of protrusion from the substrate portion shorter than a length of protrusion of the wall portion from the substrate portion;

a supporting portion that approaches the protruding portion by extending from a leading edge of the wall portion so as to be opposed to the substrate portion;

a first locking portion that protrudes from the supporting portion toward a side opposite to the substrate portion, and that is bent to the wall portion side; and a second locking portion that protrudes from the supporting portion toward the side opposite to the substrate portion, and that is bent to the protruding portion side.

With the mounting member according to the seventh aspect, for example, an additional member such as a member for preventing lateral displacement of the wall material can be easily mounted at any given position of the protruding portion.

According to an eighth aspect of the present invention, it is preferable that the wall portion has a through hole, and is inclined so as to be spaced apart from the protruding portion in a direction from the substrate portion side toward the supporting portion side.

In this case, it is possible to achieve the same effects as those achieved by the mounting members according to the third and fourth aspects.

Advantageous Effects of Invention

A mounting member and a building wall structure according to the present invention allow a mounting operation to be performed with ease.

DESCRIPTION OF EMBODIMENTS

Figure 1:
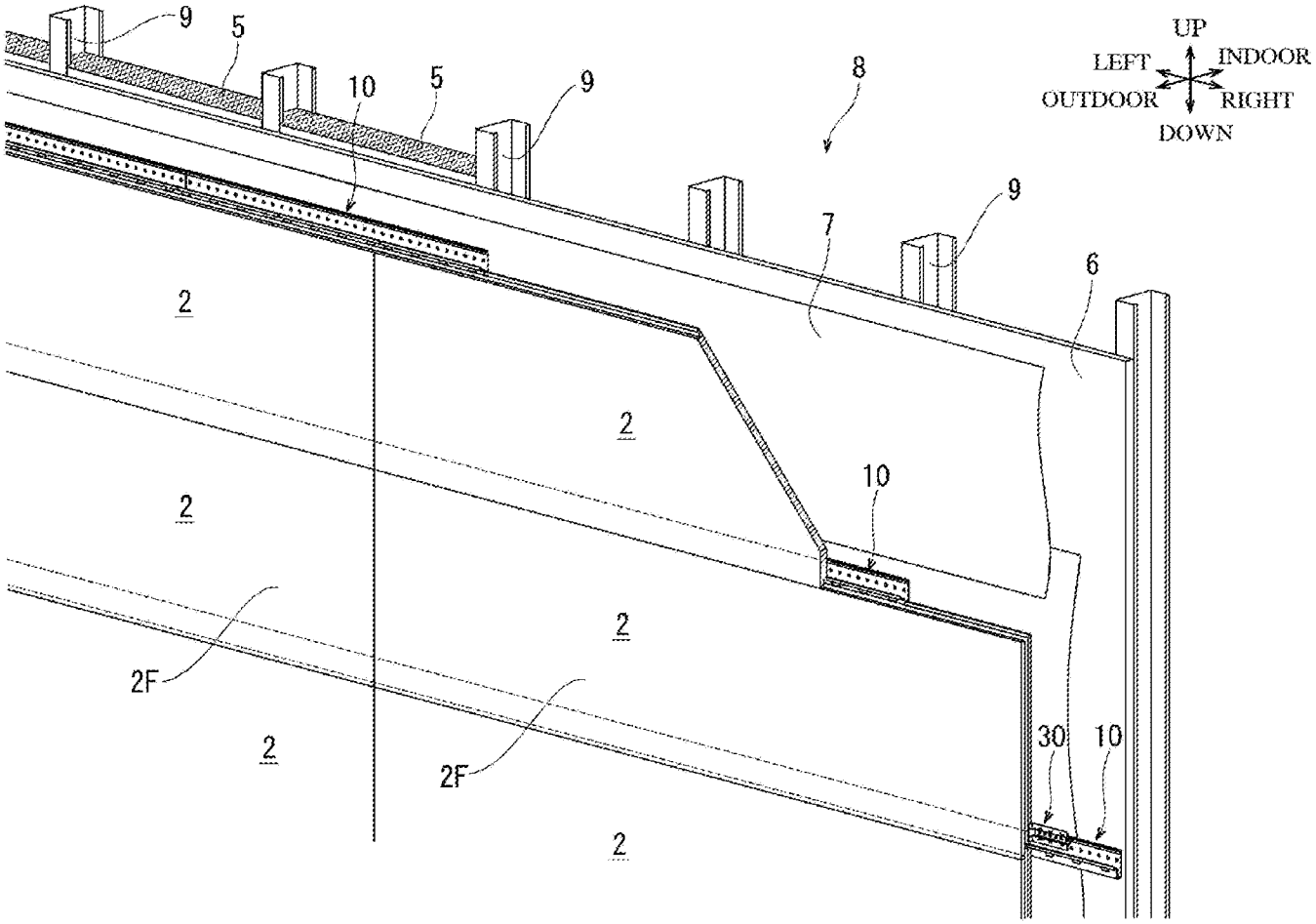
FIG. 1 is a perspective view of a building wall structure according to Embodiment 1.

In the following, Embodiments 1 to 3 of the present invention will be described with reference to the drawings. Note that, in FIG. 1, a vertically upward direction is indicated as "UP", and a vertically downward direction is indicated as "DOWN". In addition, a horizontally leftward direction in a direction from the outdoor side to the indoor side in FIG. 1 is indicated as "LEFT", and a horizontally rightward direction is indicated as "RIGHT". The directions shown in FIG. 2 and subsequent drawings are indicated so as to correspond to FIG. 1.

Embodiment 1

Figure 2:
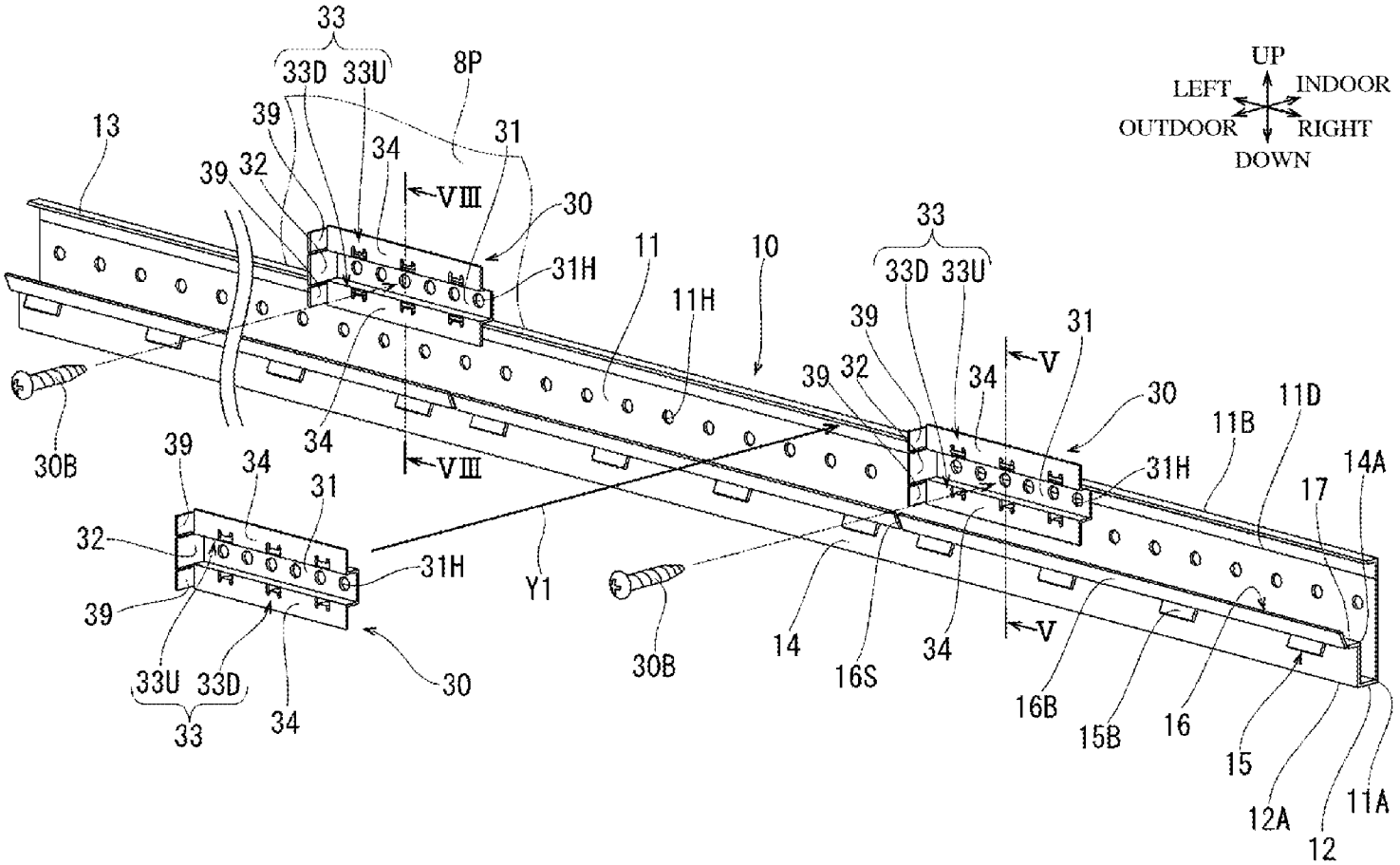
FIG. 2 is a perspective view showing a mounting member according to Embodiment 1, and abutment members with which the mounting member are equipped.
Figure 3:
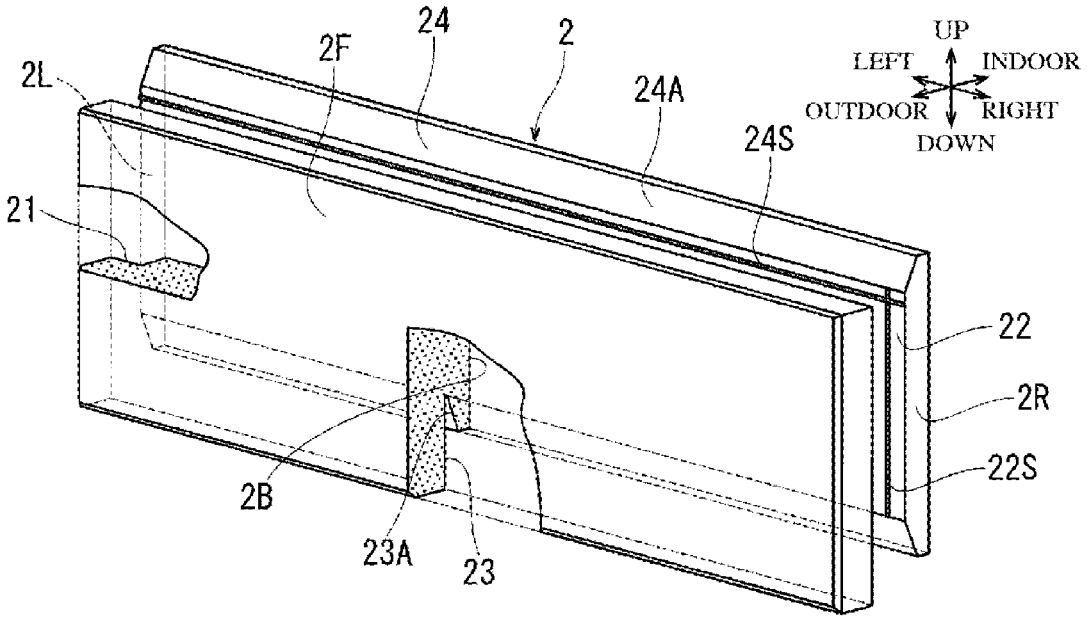
FIG. 3 is a perspective view of an exterior wall plate, according to Embodiment 1.
Figure 4:
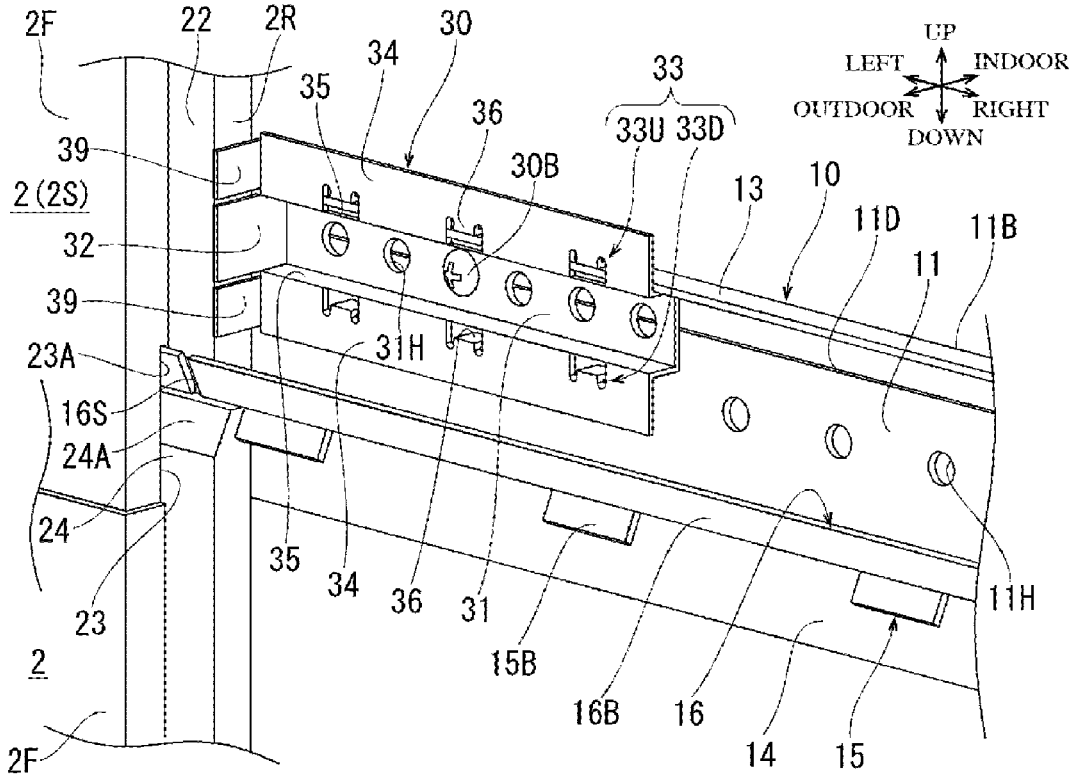
FIG. 4 is a partial perspective view showing a state in which the exterior wall plate is supported by the mounting member and the abutment member, according to Embodiment 1.

As shown in FIG. 1, a wall structure according to Embodiment 1 is an example of a specific embodiment of a wall structure. This wall structure is formed by mounting a plurality of exterior wall plates 2 to a structural body 8 that forms a building such as a residence, a facility, or a warehouse, using mounting members 10 shown in FIG. 2. Each exterior wall plate 2 is an example of the wall material. As shown in FIGS. 3, 4 and so forth, the exterior wall plate 2 is a wall material that itself has high strength and high rigidity, and forms an exterior wall of the building. Note that the wall material is not limited to an exterior wall plate, and may be, for example, a decorative plate for decorating the outside of the building, an indoor structural panel, an interior plate, or the like.

As shown in FIG. 1, the structural body 8 may be, for example, a framework such as a steel framework. The structural body 8 is made up of a plurality of structural members. The structural members include a plurality of column members 9 arranged at predetermined intervals in the horizontal direction, and auxiliary members such as studs disposed between the column members 9. A sectioned material made of steel such as C-shaped steel, or the like is used as the column members 9, the studs, and the like. Note that the structural body 8 is not limited to the configuration of the present embodiment, and may be for example, a reinforced concrete or brick framework, or a wood building.

Heat insulation material 5 is provided between the column members 9. The heat insulation material 5 is a fiber-based heat insulation material made of mineral wool fibers, glass wool fibers, or the like. The heat insulation material 5 may be a foamed plastic-based heat insulation material such as foamed polyurethane, foamed phenol, or foamed polystyrene.

A heat insulation board 6 and waterproof sheets 7 are laid on a surface of the heat insulation materials 5. The heat insulation board 6 may be, for example, a plaster board having fire resistance and sound insulation, a composite plate of a plaster board and a foamed phenol plate, a foamed polystyrene board, or the like. Each of the waterproof sheets 7 is a known waterproof sheet. The heat insulation board 6 and the waterproof sheets 7 are mounted to the column members 9 and so forth, using set screws (not shown) or the like, extend in the vertical direction and the horizontal direction, and cover the column members 9 and the auxiliary members from the outdoor side. Note that the waterproof sheets 7 may be omitted.

The mounting members 10 according to Embodiment 1 are to be fixed to the outdoor side of the column members 9, and are used for mounting a plurality of exterior wall plates 2 to the structural body 8 such that exterior wall plates 2 are disposed adjacent to each other in the vertical direction and the horizontal direction. Each mounting member 10 is an example of a specific embodiment of a mounting member.

The mounting members 10 are disposed between the column members 9 and the exterior wall plates 2. The mounting members 10 are mounted to the column members 9 at predetermined intervals in the vertical direction, and each extend in the horizontal direction. As shown in FIGS. 2, 4 and so forth, each mounting member 10 is an elongated piece of material made of a metal. The mounting member 10 is produced by, for example, bending and pressing a metal plate material. Note that the material and the production method of the mounting member 10 are not limited to those described above, and can be selected as appropriate from various materials and production methods.

Figure 5:
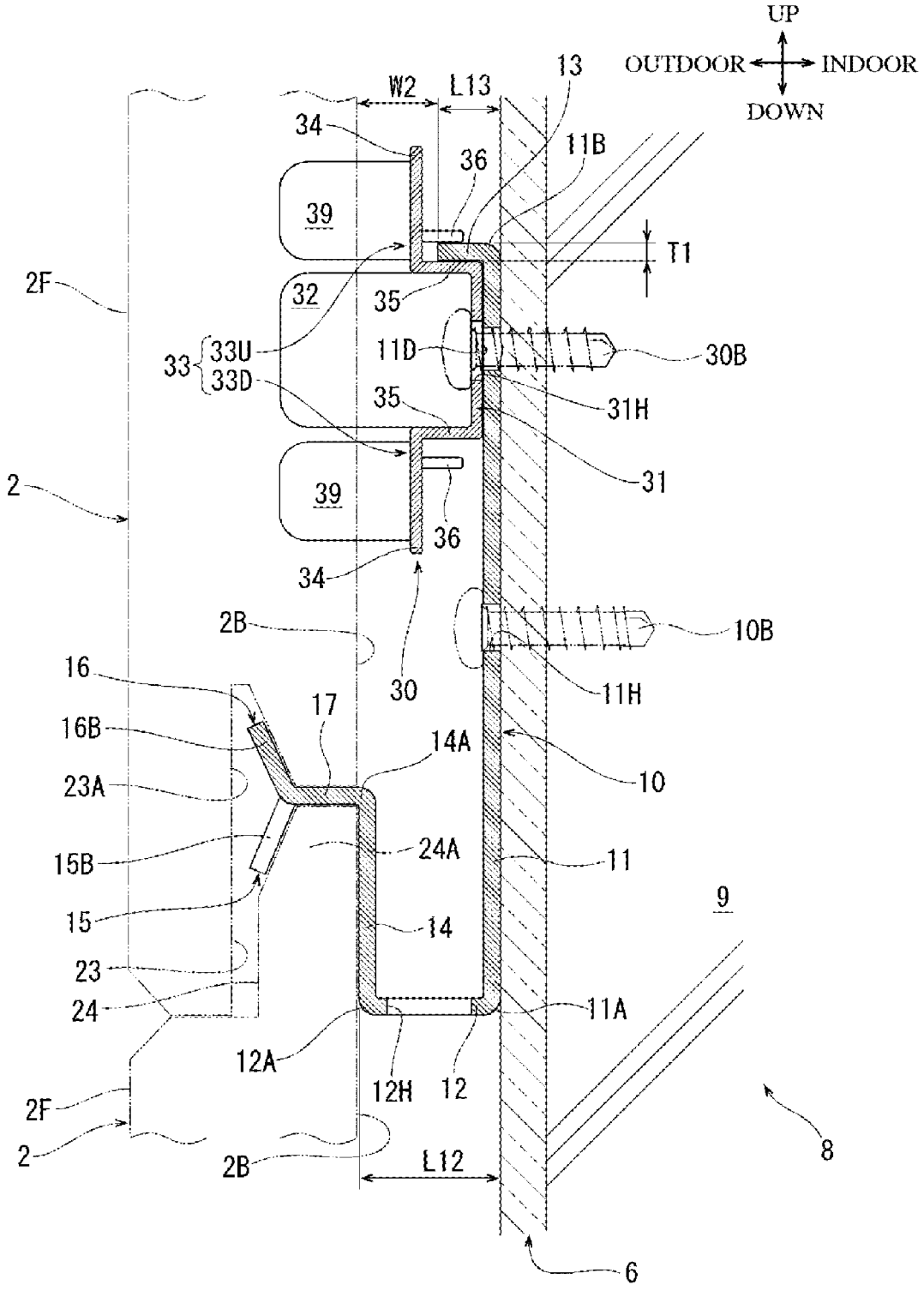
FIG. 5 is a partial cross-sectional view showing a cross section taken along the line V-V in FIG. 2.

In the following description of the shape of the mounting member 10, the vertical direction, the horizontal direction, and the indoor and outdoor directions are defined based on an orientation of the mounting member 10 that is fixed to the column member 9, as shown in FIG. 5 and so forth.

As shown in FIG. 2, the substrate portion 11 of each mounting member 10 has a rectangular shape having a length in the horizontal direction larger than a length in the vertical direction. The length of the substrate portion 11 in the horizontal direction is, for example, about 50 to 70 cm, but may be longer or shorter than this. For use, the mounting member 10 is cut as needed, depending on the installation location.

The substrate portion 11 is provided with a plurality of fixing holes 11H extending therethrough in the indoor-outdoor direction. The fixing holes 11H are disposed at substantially the center of the substrate portion 11 in the vertical direction, and are spaced apart from each other at predetermined intervals in the horizontal direction. The surface of the substrate portion 11 that faces in the indoor direction is a flat surface that can be abutted against the heat insulation board 6 and the column member 9. The surface of the substrate portion 11 that faces in the outdoor direction is also a flat surface. As shown in FIGS. 2 and 4, a recess 11D is formed in the substrate portion 11 above the fixing holes 11H. The recess 11D is recessed in the shape of a groove extending in the indoor direction from the surface of the substrate portion 11 that faces in the outdoor direction, and extends linearly in a direction parallel to an upper edge 11B of the substrate portion 11, or in other words, the horizontal direction.

As shown in FIG. 5, the substrate portion 11 is abutted against the heat insulation board 6 in a state in which the substrate portion 11 extends in the horizontal direction. The substrate portion 11 is configured to be fastened to the column members 9 as a result of screws 10B serving as fastening members for the mounting member 10 being passed through given fixing holes 11H and screwed into the column members 9 via the heat insulation board 6. In this manner, the substrate portion 11 of each mounting member 10 is configured to be fixed spanning a plurality of column members 9. The fixing holes 11H serve to determine the fixing position of the mounting member 10 and to inhibit positional displacement thereof when the mounting member 10 is fixed to the column members 9, thus facilitating an operation.

As shown in FIGS. 2 and 5, a wall portion 12 has a rectangular shape that is bent at a substantially right angle from a lower edge 11A of the substrate portion 11 so as to protrude in the outdoor direction, and that also extends in the horizontal direction. The lower edge 11A of the substrate portion 11 is an example of one side edge of the substrate portion. As shown in FIG. 5, the wall portion 12 is provided with a through hole 12H extending therethrough in the vertical direction. Although illustration has been omitted, a plurality of through holes 12H are provided in the wall portion 12 at predetermined intervals in the horizontal direction.

A protruding portion 13 has a rectangular shape that is bent from the upper edge 11B of the substrate portion 11 so as to protrude in the outdoor direction, and that extends in the horizontal direction. The upper edge 11B of the substrate portion 11 is an example of another side edge of the substrate portion. Upper and lower surfaces of the protruding portion 13 are flat surfaces. In Embodiment 1, the protruding portion 13 is formed from the upper edge 11B, which is the other side edge of the substrate portion; however, the protruding portion 13 may not necessarily be formed directly from the upper edge 11B, and may be formed from the other side edge side, or in other words, a region in the vicinity of the upper edge, including the upper edge.

A plate thickness T1 of the protruding portion 13 is the plate thickness of the metal plate material or the like that forms the mounting member 10. The length of protrusion of the protruding portion 13 in the outdoor direction is named L13, and the length of protrusion of the wall portion 12 in the outdoor direction is named L12. The length L13 is set to be shorter than the length L12. That is, a leading edge of the protruding portion 13 is at a position closer to the substrate portion 11 than a leading edge 12A of the wall portion 12 is. Accordingly, a gap W2 is formed between the leading edge of the protruding portion 13 and a back surface 2B of the exterior wall plate 2.

A supporting portion 14 is bent at a substantially right angle from the leading edge 12A of the wall portion 12, extends upward so as to be opposed to the substrate portion 11 and to approach the protruding portion 13. The supporting portion 14 has a rectangular shape having a length in the horizontal direction larger than a length in the vertical direction. The supporting portion 14 is substantially parallel to the substrate portion 11. The surface of the supporting portion 14 that faces in the outdoor direction is a flat surface that can be abutted against the back surface 2B of the exterior wall plate 2.

A plurality of first locking portions 15 and a second locking portion 16 are connected to an upper edge 14A of the supporting portion 14. Each first locking portion 15 includes a part of a bearing portion 17 that is bent at a substantially right angle from the upper edge 14A of the supporting portion 14 so as to protrude in the outdoor direction, and a first locking piece 15B. The second locking portion 16 includes another part of the bearing portion 17 and a second locking piece 16B.

The first locking pieces 15B of the first locking portion 15 protrude so as to be downwardly inclined toward the outdoor direction as a result of the bearing portion 17 being cut out into a substantially C shape at a plurality of locations thereof and bent downward, or in other words, toward the wall portion 12 side, from a leading edge of the bearing portion 17.

The second locking piece 16B of the second locking portion 16 protrudes so as to be upwardly inclined toward the outdoor direction as a result of being bent upward, or in other words, to the protruding portion 13 side, from the leading edge of the bearing portion 17. The second locking piece 16B has a rectangular shape extending in the horizontal direction. As shown in FIGS. 2 and 4, the second locking piece 16B has slits 16S formed therein at a plurality of locations at intervals in the horizontal direction.

Each mounting member 10 can be equipped with an abutment member 30. As shown in FIGS. 2, 4, 5 and so forth, the abutment member 30 is to be mounted to any given location of the protruding portion 13 of the mounting member 10, and is used for preventing the lateral displacement of the exterior wall plate 2.

The abutment member 30 is produced by, for example, bending and pressing a metal plate material. Note that the material and the production method of the abutment member 30 are not limited to those described above, and can be selected as appropriate from various materials and production methods.

In the following description of the shape of the abutment member 30, the vertical direction, the horizontal direction, and the indoor and outdoor directions are defined based on the orientation of the abutment member 30 that is fixed to the mounting member 10, as shown in FIG. 5 and so forth.

As shown in FIGS. 2 and 4 to 7, the abutment member 30 includes a mounting portion 31, an erect piece 32, and a clamping portion 33.

The mounting portion 31 has a substantially rectangular shape having a length in the horizontal direction larger than a length in the vertical direction. The surface of the mounting portion 31 that faces in the indoor direction is a flat surface that can be abutted against a surface of the substrate portion 11 of the mounting member 10 that faces in the outdoor direction.

The mounting portion 31 is provided with six fixing holes 31H extending therethrough in the indoor-outdoor direction. The fixing holes 31H are spaced apart from each other at predetermined intervals in the horizontal direction. The fixing holes 31H are disposed at substantially the center of the mounting portion 31 in the vertical direction. A screw 30B serving as a fastening member for the abutment member 30 is inserted into each of the fixing holes 31H when the abutment member 30 is fixed to the mounting member 10.

The erect piece 32 is a substantially rectangular piece that is bent at a substantially right angle from a left edge of the mounting portion 31 so as to protrude in the outdoor direction, and that also extends in the vertical direction.

The clamping portion 33 includes an upper clamping portion 33U provided as a single piece with the mounting portion 31 on the upper edge side thereof, and a lower clamping portion 33D provided as a single piece with the mounting portion 31 on the lower edge side thereof. The upper clamping portion 33U and the lower clamping portion 33D have the same but mirrored shape. Therefore, the same reference numerals are given to the constituent elements of the upper clamping portion 33U and the constituent elements of the lower clamping portion 33D, and the descriptions thereof have been omitted or simplified.

Specifically, the upper clamping portion 33U includes a first clamping portion 35, a second clamping portion 36, a plate portion 34, and an auxiliary erect piece 39. The lower clamping portion 33D also includes a first clamping portion 35, a second clamping portion 36, a plate portion 34, and an auxiliary erect piece 39. The first clamping portion 35, the second clamping portion 36, the plate portion 34, and the auxiliary erect piece 39 of the upper clamping portion 33U respectively have the same but mirrored shape as the first clamping portion 35, the second clamping portion 36, the plate portion 34, and the auxiliary erect piece 39 of the lower clamping portion 33D. Therefore, the configuration of the upper clamping portion 33U will be described in detail, and the description of the configuration of the lower clamping portion 33D has been omitted.

As shown in FIGS. 4 to 7, at the upper clamping portion 33U, the first clamping portion 35 has a rectangular shape that is bent from an edge of the mounting portion 31 so as to protrude in the outdoor direction, and that extends in the horizontal direction. The surface of the first clamping portion 35 that is directed to the side opposite to the mounting portion 31 is a flat surface that can be abutted against the protruding portion 13.

At the upper clamping portion 33U, the plate portion 34 is connected to a leading edge of the first clamping portion 35. The plate portion 34 is bent from the leading edge of the first clamping portion 35, and extends upward so as to be spaced apart from the mounting portion 31 and the first clamping portion 35. The plate portion 34 has a substantially rectangular shape having a length in the horizontal direction larger than a length in the vertical direction.

At the upper clamping portion 33U, three second clamping portions 36 are formed on the plate portion 34. The second clamping portions 36 are spaced apart from each other at predetermined intervals in the horizontal direction. Each second clamping portion 36 is formed by cutting out a part of the plate portion 34 and a part of the first clamping portion 35 into a substantially C shape to form a groove, and bending the inner portion of that groove from the plate portion 34. The second clamping portion 36 is a substantially rectangular piece that is bent from the plate portion 34 so as to protrude in the indoor direction. That is, the plate portion 34 connects the first clamping portion 35 and the second clamping portion 36.

As shown in FIG. 5, the second clamping portion 36 extends parallel to the first clamping portion 35 so as to be opposed thereto. The surface of the second clamping portion 36 that is opposed to the first clamping portion 35 is a flat surface that can be abutted against the protruding portion 13 from the side opposite to the first clamping portion 35.

Figure 6:
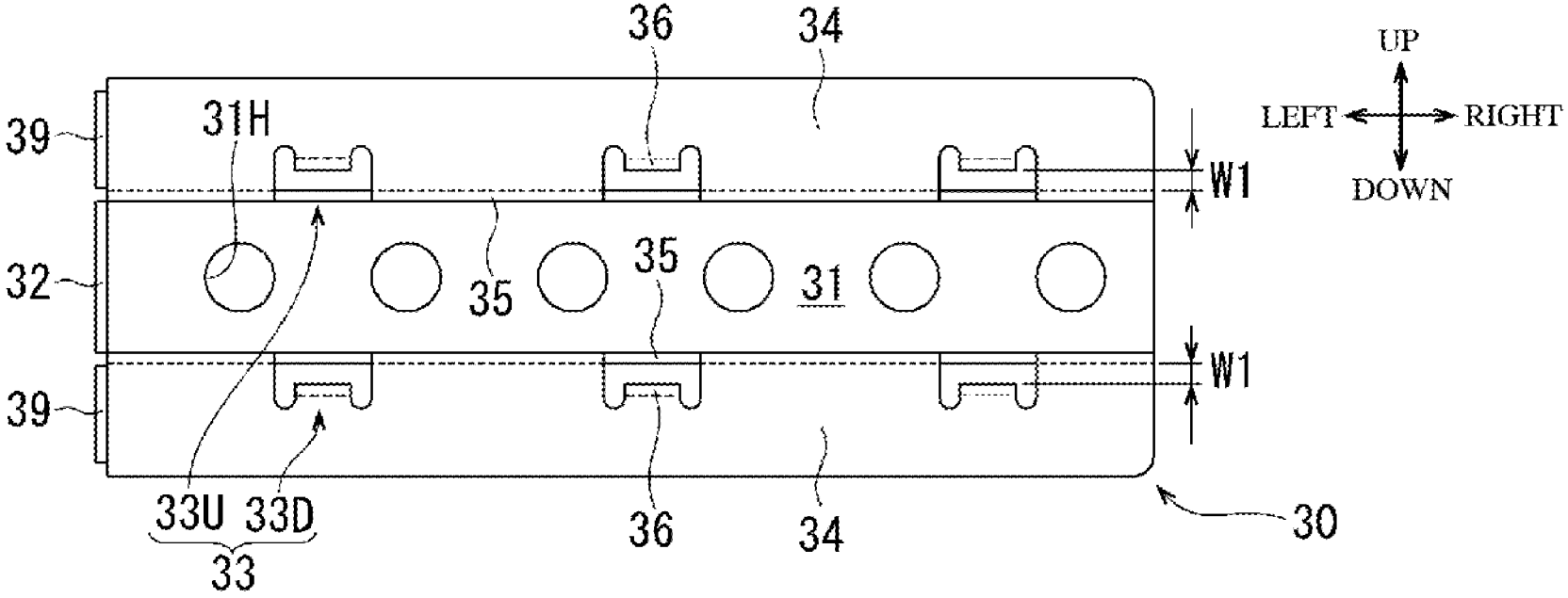
FIG. 6 is a front view of the abutment member, according to Embodiment 1.
Figure 7:
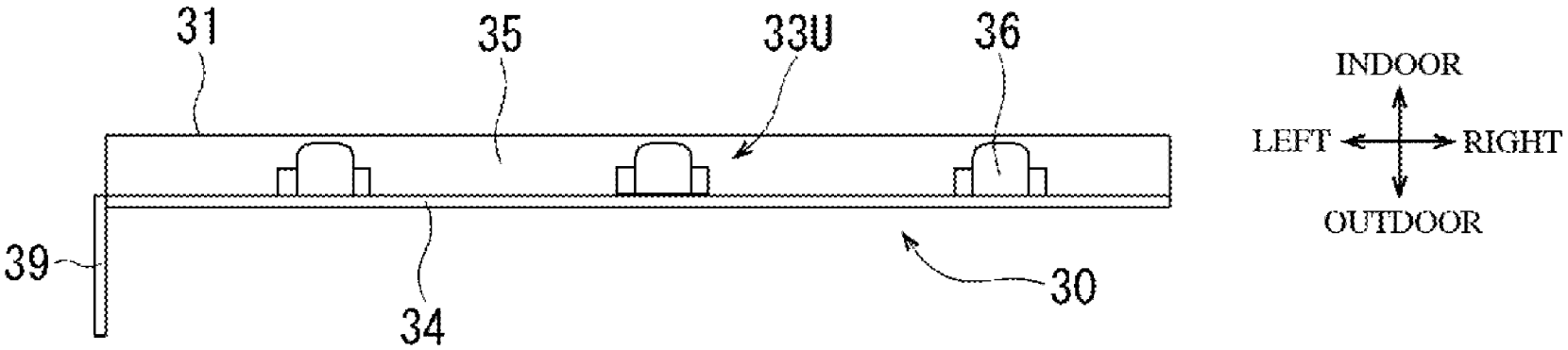
FIG. 7 is a top view of the abutment member, according to Embodiment 1.

As shown in FIG. 6, the second clamping portion 36 is provided with a gap W1 that is substantially equal to the plate thickness T1 of the protruding portion 13 of the mounting member 10 between the first clamping portion 35 and the second clamping portion 36.

The auxiliary erect piece 39 is a substantially rectangular piece that is bent at a substantially right angle from the left edge of the plate portion 34 so as to protrude in the outdoor direction, and that also extends in the vertical direction. The auxiliary erect piece 39 is disposed on the same plane as the erect piece 32.

With the clamping portion 33 having such a configuration, the upper clamping portion 33U of the abutment member 30 is caused to approach the mounting member 10 from a direction intersecting the substrate portion 11, or in other words, in a direction (direction indicated by an arrow Y1) from the outdoor side toward the indoor side as shown on the right side on the plane of paper in FIG. 2, and the protruding portion 13 is moved into the gap W1 between the first clamping portion 35 and the second clamping portion 36 of the upper clamping portion 33U, whereby the first clamping portion 35 and the second clamping portion 36 of the upper clamping portion 33U clamp the protruding portion 13.

As shown on the left side on the plane of paper in FIG. 2, the lower clamping portion 33D of the abutment member 30 is caused to approach the mounting member 10 in a direction (direction indicated by the arrow Y1) from the outdoor side toward the indoor side, and the protruding portion 13 is moved into the gap W1 between the first clamping portion 35 and the second clamping portion 36 of the lower clamping portion 33D, whereby the first clamping portion 35 and the second clamping portion 36 of the lower clamping portion 33D clamp the protruding portion 13.

Figure 8:
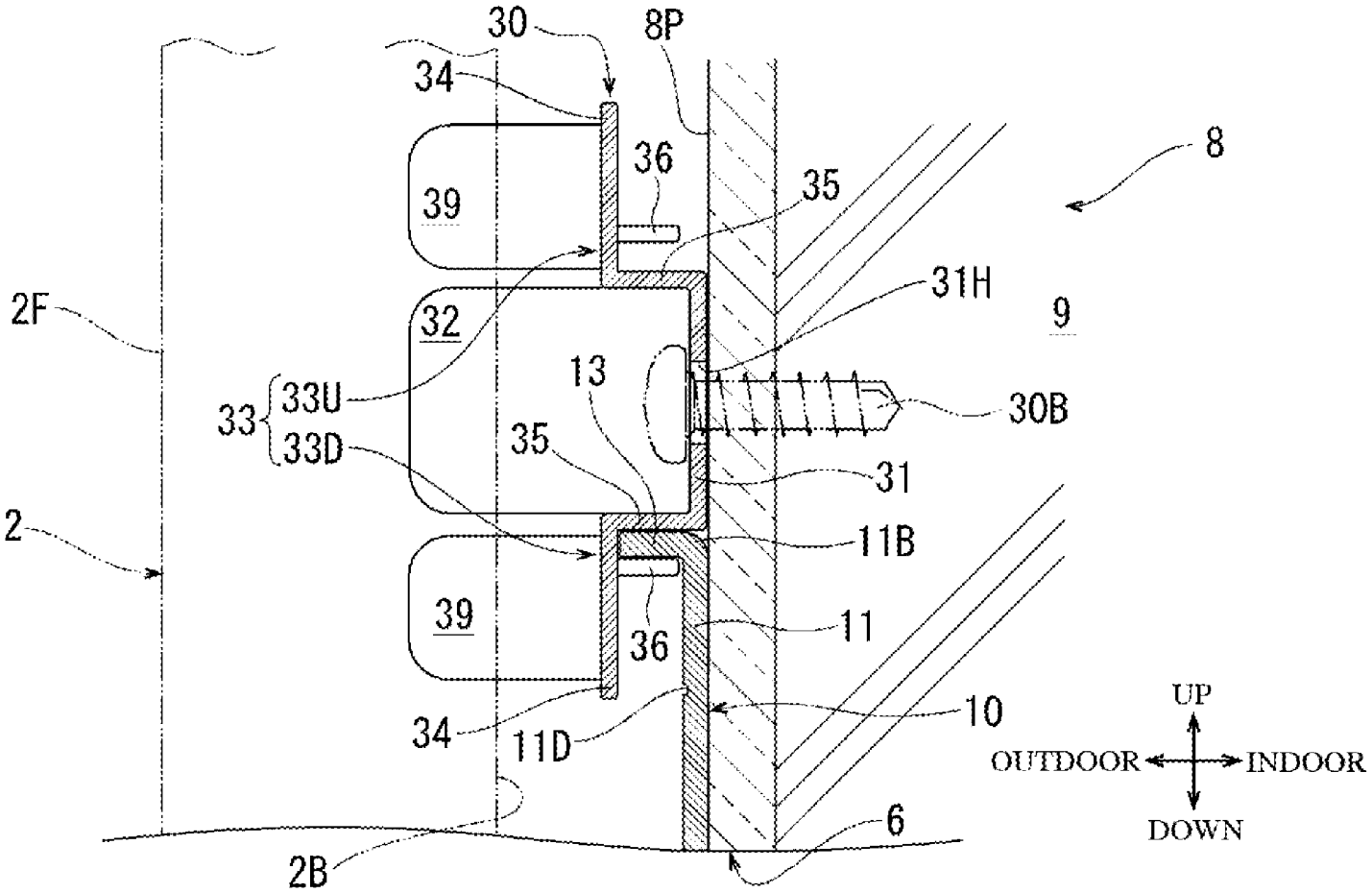
FIG. 8 is a partial cross-sectional view showing a cross section taken along the line VIII-VIII in FIG. 2.

In this manner, as a result of the clamping portion 33 clamping the protruding portion 13, the abutment member 30 can easily be temporarily mounted to the protruding portion 13 of the mounting member 10. In this state, as shown in FIGS. 5 and 8, the screw 30B passes through a given fixing hole 31H, and is fastened onto at least one of the substrate portion 11 and substantially the same plane 8P as the substrate portion 11 (to the front surface of the heat insulation board 6). The screw 30B is an example of a fastening member.

In the example shown in FIGS. 4 and 5, the screw 30B is passed through the fixing hole 31H, and is screwed into the substrate portion 11, whereby the mounting portion 31 is fastened to the substrate portion 11. At this time, the recess 11D of the substrate portion 11 is disposed at a position where it passes through the center of the fixing hole 31H in a state in which the first clamping portion 35 and the second clamping portion 36 of the upper clamping portion 33U clamp the protruding portion 13 and the mounting portion 31 is opposed to the substrate portion 11. Accordingly, a tapered leading end of the screw 30B that is inserted into the fixing hole 31H catches on the recess 11D, and, thus, positional displacement of the screw 30B relative to the fixing hole 31H can be suppressed.

In the example shown in FIG. 8, the screw 30B is passed through the fixing hole 31H, and is screwed into the heat insulation board 6 and the column member 9, whereby the mounting portion 31 is fastened on substantially the same plane 8P as the substrate portion 11 (to the front surface of the heat insulation board 6). In this manner, the mounting portion 31 of the abutment member 30 can be fixed to any given position of the substrate portion 11 of the mounting member 10.

As shown in FIG. 3, each exterior wall plate 2 is a plate material having a quadrilateral shape, or more specifically, a horizontally elongated, substantially rectangular shape. In the present embodiment, the exterior wall plate 2 is made of a ceramic material including cement. Note that the material and the shape of the exterior wall plate 2 are not limited to those described above. For example, a metal material, a wood material, a resin material, or the like can be selected as appropriate as the material of the exterior wall plate 2. As for the shape of the exterior wall plate 2, a plate material having a quadrilateral shape, i.e., a vertically elongated, substantially rectangular shape can be selected as appropriate, for example.

A front surface 2F of the exterior wall plate 2 is, for example, an exterior surface provided with a design such as a brick pattern. A front horizontal joint portion 21 is formed at a left end portion of the exterior wall plate 2. A back horizontal joint portion 22 is formed at a right end portion of the exterior wall plate 2. A front vertical joint portion 23 is formed at a lower end portion of the exterior wall plate 2. A back vertical joint portion 24 is formed at an upper end portion of the exterior wall plate 2. Note that, in FIG. 3, the sizes of the front horizontal joint portion 21, the back horizontal joint portion 22, the front vertical joint portion 23, and the back vertical joint portion 24 are shown in an exaggerated manner, relative to the size of the exterior wall plate 2.

The front horizontal joint portion 21 is recessed from the back surface 2B toward the front surface 2F of the exterior wall plate 2, and extends in the vertical direction, that is, along the left end portion of the exterior wall plate 2.

The back horizontal joint portion 22 is recessed from the front surface 2F toward the back surface 2B of the exterior wall plate 2, and extends in the vertical direction, that is, along the right end portion of the exterior wall plate 2. A caulking material 22S is provided on a flat surface of the back horizontal joint portion 22 that is directed in the outdoor direction. The caulking material 22S is provided linearly along the back horizontal joint portion 22. Note that a caulking material is not essential, and the caulking material 22S may be omitted.

The front vertical joint portion 23 is recessed from the back surface 2B toward the front surface 2F of the exterior wall plate 2, and extends in the horizontal direction, that is, along the lower end portion of the exterior wall plate 2. An engagement recess 23A that is recessed upward in a substantially tapered shape is formed in the front vertical joint portion 23.

The back vertical joint portion 24 is recessed from the front surface 2F toward the back surface 2B of the exterior wall plate 2, and extends in the horizontal direction, that is, along the upper end portion of the exterior wall plate 2. A caulking material 24S is provided on a flat surface of the back vertical joint portion 24 that is directed in the outdoor direction. The caulking material 24S is provided linearly along the back vertical joint portion 24. Note that the caulking material is not essential, and the caulking material 24S may be omitted. An engagement protrusion 24A that protrudes upward in a substantially tapered shape is formed on the back vertical joint portion 24, above the upper side of the caulking material 24S.

As shown in FIG. 4, a vertical shiplap portion extending in the horizontal direction is formed between vertically adjacent exterior wall plates 2 as a result of the back vertical joint portion 24 of the lower exterior wall plate 2 and the front vertical joint portion 23 of the upper exterior wall plate 2 overlapping each other. Although the illustration has been omitted, a horizontal shiplap portion extending in the vertical direction is formed between horizontally adjacent exterior wall plates 2 as a result of the front horizontal joint portion 21 of the right exterior wall plate 2 and the back horizontal joint portion 22 of the left exterior wall plate 2 overlapping each other. That is, each exterior wall plate 2 is a plate material having a so-called "four-side shiplap structure", including the front horizontal joint portion 21, the back horizontal joint portion 22, the front vertical joint portion 23, and the back vertical joint portion 24.

As shown in FIGS. 1, 4, and 5, the exterior wall plates 2 are mounted to the structural body 8 in the following manner, using the mounting members 10.

As shown in FIG. 1, a plurality of mounting members 10 are mounted at positions on the lower side of the column members 9 so as to extend in the horizontal direction. Then, the plurality of exterior wall plates 2 are mounted to the mounting members 10 in a state in which the exterior wall plates 2 are disposed adjacent to each other in the horizontal direction. At this time, as shown in FIG. 5, the lower end portions of the exterior wall plates 2 are supported by the mounting members 10 due to the second locking portions 16 of the mounting members 10 locking with the engagement recesses 23A. An engagement recess 23A is an example of another end portion of the exterior wall plate 2.

Next, as shown in FIG. 1, another plurality of mounting members 10 are mounted to the exterior wall plates 2 from above so as to extend in the horizontal direction. At this time, as shown in FIGS. 4 and 5, the upper end portions of the exterior wall plates 2 are supported by the mounting members 10 due to the first locking portions 15 of the mounting members 10 locking with the engagement protrusions 24A. An engagement protrusion 24A is an example of one end portion of the exterior wall plate 2.

Then, to the upper mounting members 10, a plurality of exterior wall plates 2 are further mounted in a state in which the exterior wall plates 2 are disposed adjacent to each other in the horizontal direction. Also at this time, as shown in FIGS. 4 and 5, the lower end portions of the exterior wall plates 2 are supported by the mounting members 10 due to the second locking portions 16 of the mounting members 10 locking with the engagement recesses 23A.

Here, the abutment member 30 is used when a plurality of exterior wall plates 2 are mounted in a state in which the exterior wall plates 2 are disposed adjacent to each other in the horizontal direction. As shown in FIG. 4, in a state in which the erect piece 32 and the auxiliary erect pieces 39 are abutted from the right side against a right side end portion 2R of a specific exterior wall plate 2 (2S) whose engagement recess 23A is locked by the second locking portion 16 of a mounting member 10, the upper clamping portion 33U of the abutment member 30 is temporarily mounted to the protruding portion 13 of the mounting member 10. Furthermore, a screw 30B is inserted into a fixing hole 31H and the recess 11D, and is screwed into the heat insulation board 6 and the column member 9, whereby the mounting portion 31 is fastened to the substrate portion 11. Accordingly, the specific exterior wall plate 2 (2S) is prevented from being horizontally displaced to the right. Then, although the illustration has been omitted, another exterior wall plate 2 is disposed adjacent to the specific exterior wall plate 2 (2S) from the right. That is, a left side end portion 2L (see FIG. 2) of that exterior wall plate 2 is abutted from the right against the erect piece 32 and the auxiliary erect pieces 39.

Although the illustration and the description have been omitted, the same also applies to a case where, in a state in which the erect piece 32 and the auxiliary erect pieces 39 are abutted from the right against the right side end portion 2R of the specific exterior wall plate 2 (2S), the lower clamping portion 33D of the abutment member 30 may also be similarly temporarily mounted to the protruding portion 13 of the mounting member 10, as shown in FIG. 8.

In this manner, the mounting member 10 is configured to support corner portions of a plurality of exterior wall plates 2 that are abutted against each other, or in other words, four-side shiplap portions. In addition, as a result of the supporting portion 14 of the mounting member 10 being abutted against the back surface 2B of the exterior wall plate 2, a ventilation space is secured between the wall surface of the structural body 8 and the back surface 2B of the exterior wall plate 2.

By performing such an operation also for other exterior wall plates 2, the exterior wall plates 2 are supported by the structural body 8 in a state in which the exterior wall plates 2 are disposed adjacent to each other in the vertical direction and the horizontal direction, and cover the wall surface of the structural body 8.

Operation and Effect

With the mounting member 10 and the wall structure according to Embodiment 1, the protruding portion 13 of the mounting member 10 can be clamped by the upper clamping portion 33U or the lower clamping portion 33D, each of which is a component of the clamping portion 33, simply by causing the abutment member 30 to approach the substrate portion 11 by moving the abutment member 30 in the direction from the outdoor side toward the indoor side as indicated by the arrow Y1 in FIG. 2. That is, the abutment member 30 can be easily temporarily mounted to the protruding portion 13 of the mounting member 10 from the outdoor side. Then, as shown in FIGS. 4, 5, and 8, the mounting portion 31 of the temporarily mounted abutment member 30 can be safely fixed, using the screw 30B, onto at least one of the substrate portion 11 and substantially the same plane 8P as the substrate portion 11 (to the front surface of the heat insulation board 6).

As shown in FIG. 5, with the mounting member 10 and the wall structure, the length L13 of protrusion of the protruding portion 13 from the substrate portion 11 is shorter than the length L12 of protrusion of the wall portion 12 from the substrate portion 11, and it is therefore possible to easily achieve weight reduction.

Accordingly, the mounting member 10 and the wall structure according to Embodiment 1 allow a mounting operation to be performed with ease and safely, and can achieve weight reduction.

With the mounting member 10 and the wall structure, the gap W2 is formed between the leading edge of the protruding portion 13 and the back surface 2B of the exterior wall plate 2. Accordingly, it is possible to ensure ventilation in the surrounding region of the mounting member 10.

Furthermore, with the mounting member 10 and the wall structure, even if a worker should accidentally drop the abutment member 30 when temporarily mounting the abutment member 30, the abutment member 30 can be received/caught by the wall portion 12. Also, even if the gap W1 between the first clamping portion 35 and the second clamping portion 36 is larger than the plate thickness T1 of the protruding portion 13, the clamping portion 33 is unlikely to fall off from the protruding portion 13 because the clamping portion 33 is stopped in abutment by the protruding portion 13.

With the mounting member 10 and the wall structure, the first clamping portion 35, the second clamping portion 36, and the plate portion 34 included in the upper clamping portion 33U and the lower clamping portion 33D that constitute the clamping portion 33 can be easily formed, for example, by bending a sheet metal. Also, the protruding portion 13 can be reliably clamped by the first clamping portion 35 and the second clamping portion 36 while the worker is holding the plate portion 34.

Furthermore, with the mounting member 10 and the wall structure, ventilation can be ensured in the surrounding region of the mounting member 10 by the through holes 12H of the wall portion 12, and the space between the back surface 2B of the exterior wall plate 2 and the substrate portion 11, as shown in FIG. 5. In addition, rainwater or the like that has reached the wall portion 12 is allowed to flow downward through the through holes 12H. As a result, it is possible to suppress a reduction in strength and durability of the exterior wall plate 2 and the structural body 8.

With the mounting member 10 and the wall structure, the recess 11D of the substrate portion 11 is disposed at a position where it passes through the center of the fixing hole 31H in a state in which the upper clamping portion 33U clamps the protruding portion 13 and the mounting portion 31 is opposed to the substrate portion 11, as shown in FIGS. 4 and 5. Accordingly, a tapered leading end of the screw 30B that is inserted into the fixing hole 31H moves into the recess 11D, whereby positional displacement of the screw 30B relative to the fixing hole 31H can be suppressed. As a result, a mounting operation can be performed more easily and safely.

Embodiment 2

Figure 9:
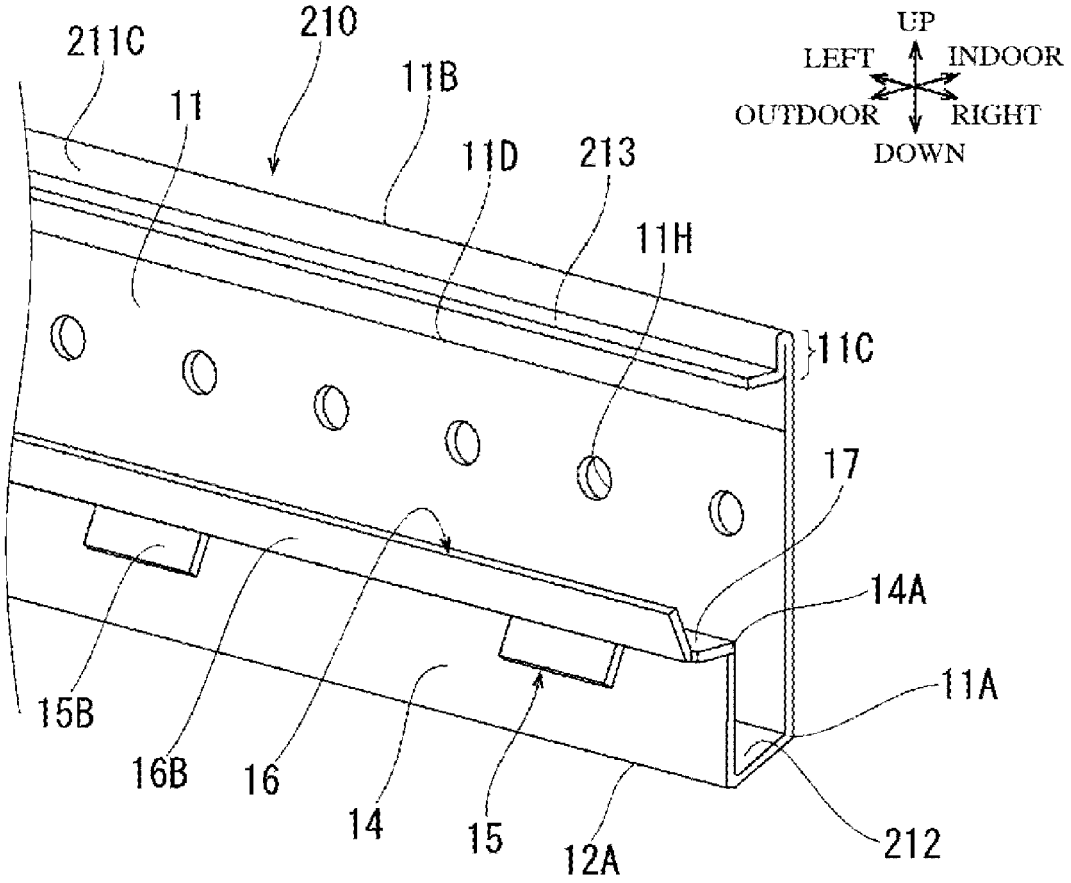
FIG. 9 is a partial perspective view of a mounting member according to Embodiment 2.
Figure 10:
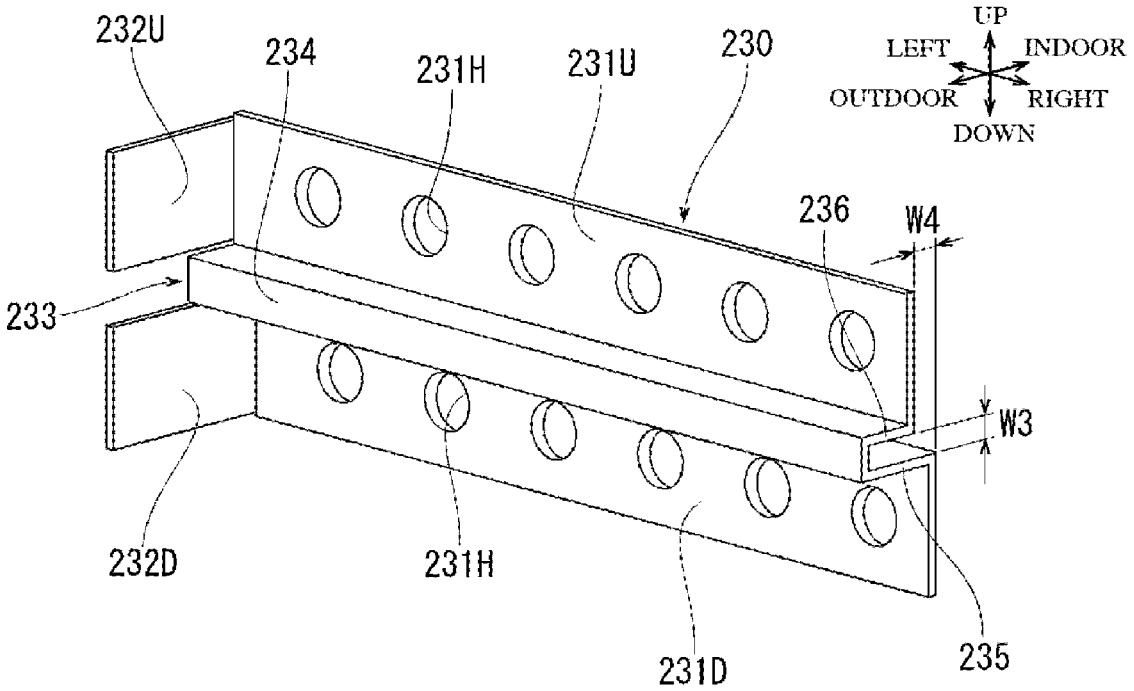
FIG. 10 is a perspective view showing an abutment member with which the mounting member according to Embodiment 2 is equipped.
Figure 11:
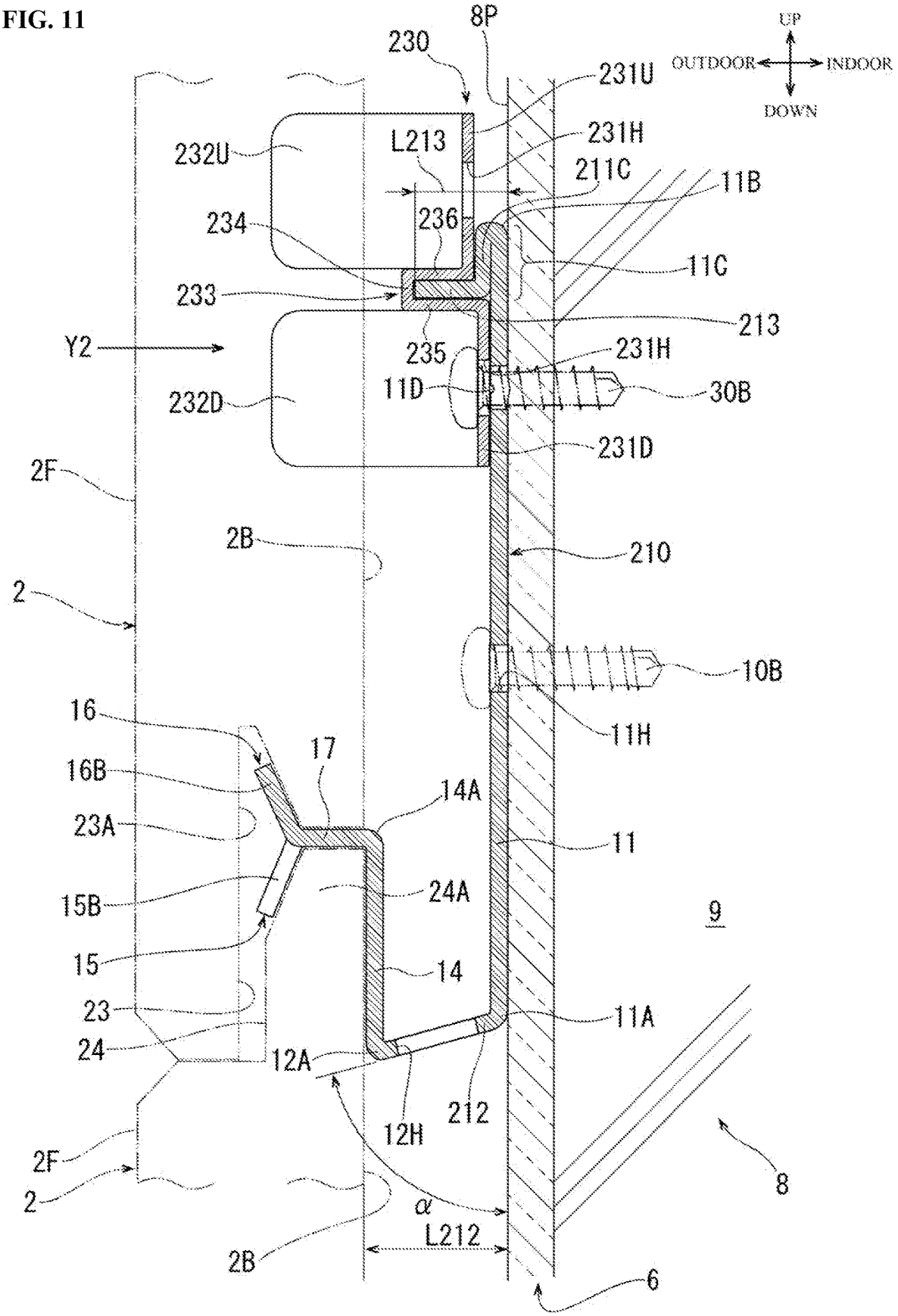
FIG. 11 is a partial cross-sectional view showing a cross-section similar to that shown in FIG. 5, according to Embodiment 2.

As shown in FIGS. 9 to 11, for a mounting member 210 and a wall structure according to Embodiment 2, a mounting member 210 is used in place of the mounting member 10 according to Embodiment 1, and an abutment member 230 is used in place of the abutment member 30 according to Embodiment 1. The rest of the configuration of Embodiment 2 is the same as that of Embodiment 1. Therefore, the same components as those of Embodiment 1 are denoted by the same reference numerals, and the descriptions thereof have been omitted or simplified.

The mounting member 210 according to Embodiment 2 includes a wall portion 212, a folded piece 211C, and a protruding portion 213. The rest of the configuration of the mounting member 210 is the same as that of the mounting member 10 according to Embodiment 1.

The wall portion 212 is downwardly inclined so as to be spaced apart from the protruding portion 213 in a direction from the substrate portion 11 side toward the supporting portion 14 side. Specifically, as shown in FIG. 11, an angle $\alpha$ formed by the wall portion 212 and an extension of the substrate portion 11 is set to 80 degrees. The angle $\alpha$ of 80 degrees is merely an example, and may be changed as appropriate. The rest of the configuration of the wall portion 212 is the same as that of the wall portion 12 according to Embodiment 1.

The folded piece 211C is folded from the upper edge 11B of the substrate portion 11 so as to extend downward.

The protruding portion 213 protrudes to the same side as the wall portion 212, not from the upper edge 11B, which is the other side edge of the substrate portion 11, but from a side edge portion 11C that is bent from a lower edge of the folded piece 211C, which is formed by folding the upper edge 11B to the outdoor side. That is, in Embodiment 2, the protruding portion 213 protrudes from a region located on the other side edge side of the substrate portion 11. As shown in FIG. 11, a length L213 of protrusion of the protruding portion 213 from the substrate portion 11 is set to be shorter than a length L212 of protrusion of the wall portion 212 from the substrate portion 11. The rest of the configuration of the protruding portion 213 is the same as that of the protruding portion 13 according to Embodiment 1.

FIG. 10 shows the abutment member 230 according to Embodiment 2, and a mounting portion 231U of the abutment member 230 has a substantially rectangular shape having a length in the horizontal direction larger than a length in the vertical direction. The surface of the mounting portion 231U that faces in the indoor direction is a flat surface that can be abutted against the surface of the substrate portion 11 of the mounting member 210 that faces in the outdoor direction. The mounting portion 231U is provided with six fixing holes 231H extending therethrough in the indoor-outdoor direction. The fixing holes 231H are spaced apart from each other at predetermined intervals in the horizontal direction.

A mounting portion 231D has the same shape as the mounting portion 231U except that the mounting portion 231D is located at a lower position relative to the mounting portion 231U. The mounting portion 231U is located at a position that is displaced to the outdoor direction relative to the mounting portion 231D by an interval W4 corresponding to the plate thickness of the folded piece 211C.

An erect piece 232U is a substantially rectangular piece that is bent at a substantially right angle from a left edge of the mounting portion 231U so as to protrude in the outdoor direction, and that also extends in the vertical direction. An erect piece 232D is a substantially rectangular piece that is bent at a substantially right angle from a left edge of the mounting portion 231D so as to protrude in the outdoor direction, and that also extends in the vertical direction. The erect piece 232U and the erect piece 232D are disposed on the same plane.

A clamping portion 233 includes a first clamping portion 235, a second clamping portion 236, and a plate portion 234. The first clamping portion 235 has a rectangular shape that is bent from an upper edge of the mounting portion 231D so as to protrude in the outdoor direction, and that also extends in the horizontal direction. As shown in FIG. 11, the surface of the first clamping portion 235 that is directed to the side opposite to the mounting portion 231D is a flat surface that can be abutted against the protruding portion 213 from below. The second clamping portion 236 has a rectangular shape that is bent from a lower edge of the mounting portion 231U so as to protrude in the outdoor direction, and that also extends in the horizontal direction. As shown in FIG. 11, the surface of the second clamping portion 236 that is directed to the side opposite to the mounting portion 231U is a flat surface that can be abutted against the protruding portion 213 from above. The plate portion 234 connects the first clamping portion 235 and the second clamping portion 236 on the side opposite to the mounting portions 231U and 231D. A gap W3 between the first clamping portion 235 and the second clamping portion 236 is the same as the gap W1 between the first clamping portion 35 and the second clamping portion 36 according to Embodiment 1.

With the mounting member 210 and the wall structure according to Embodiment 2 having such a configuration, the protruding portion 213 of the mounting member 210 can be clamped by the first clamping portion 235 and the second clamping portion 236 of the clamping portion 233 simply by causing the abutment member 230 to approach the substrate portion 11 by moving the abutment member 230 in a direction from the outdoor side toward the indoor side as indicated by an arrow Y2 in FIG. 11. That is, the abutment member 230 can be easily temporarily mounted to the protruding portion 213 of the mounting member 210 from the outdoor side. Then, the mounting portion 231D of the temporarily mounted abutment member 230 can be safely fixed to the substrate portion 11 using the screw 30B. Although the illustration has been omitted, the mounting portion 231U of the temporarily mounted abutment member 230 can be safely fixed, using the screw 30B, on substantially the same plane 8P as the substrate portion 11 (onto the front surface of the heat insulation board 6).

With the mounting member 210 and the wall structure, the length L213 of protrusion of the protruding portion 213 from the substrate portion 11 is shorter than the length L212 of protrusion of the wall portion 212 from the substrate portion 11, and it is therefore possible to easily achieve weight reduction.

Accordingly, as in the case of Embodiment 1, the mounting member 210 and the wall structure according to Embodiment 2 also allow a mounting operation to be performed with ease and safely, and can realize weight reduction.

As shown in FIG. 11, with the mounting member 210 and the wall structure, the side edge portion 11C of the substrate portion 11 is formed as the folded piece 211C, and therefore, the mounting member 210 has high rigidity. Furthermore, the wall portion 212 is downwardly inclined so as to be spaced apart from the protruding portion 213 in a direction from the substrate portion 11 side toward the supporting portion 14 side. Accordingly, rainwater or the like that has reached the wall portion 212 is allowed to flow in a direction away from the structural body 8 due to the incline. Then, the rainwater or the like that has flown in a direction away from the structural body 8 is allowed to flow downward through the through holes 12H formed in the wall portion 212. As a result, it is possible to suppress a reduction in strength and durability of the exterior wall plate 2 and the structural body 8.

Embodiment 3

Figure 12:
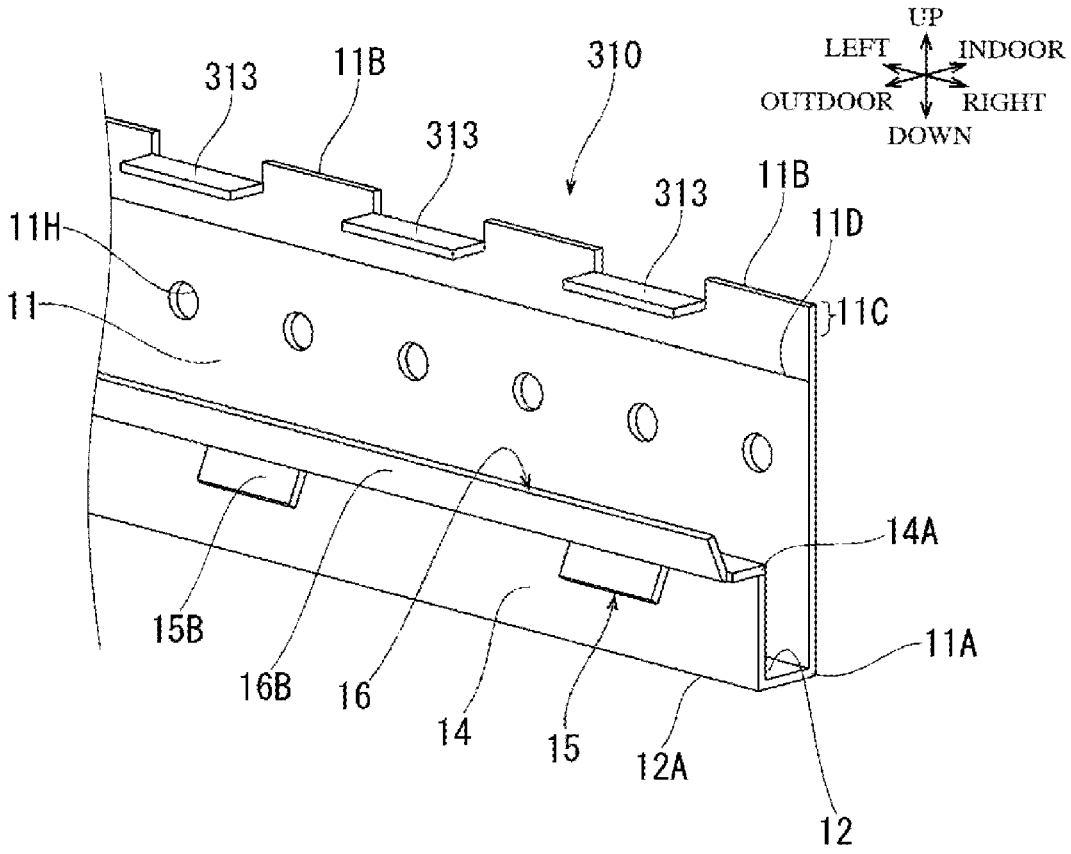
FIG. 12 is a partial perspective view of a mounting member according to Embodiment 3.

As shown in FIG. 12, for a mounting member 310 according to Embodiment 3, protruding portions 313 are formed by a plurality of plate-shaped pieces that are made by making cuts extending downward from the upper edge 11B of the substrate portion 11 and bending the pieces toward the outdoor direction. The protruding portions 313 are disposed on the same plane as the substrate portion 11 at a position displaced downward relative to the upper edge 11B. That is, the protruding portions 313 protrude to the same side as the wall portion 12, not from the upper edge 11B of the substrate portion 11, but from the side edge portion 11C. The rest of the configuration of Embodiment 3 is the same as that of Embodiment 1. Therefore, the same components as those of Embodiment 1 are denoted by the same reference numerals, and the descriptions thereof have been omitted or simplified.

With the mounting member 310 according to Embodiment 3 having such a configuration, it is also possible to achieve the same effects as those achieved by the mounting members 10 and 210 according to Embodiments 1 and 2.

Although the present invention has been described above by way of Embodiments 1 to 3, the present invention is not limited to Embodiments 1 to 3 described above. Needless to say, modifications may be made as appropriate without departing from the scope and spirit of the invention.

For example, the present invention also encompasses a configuration in which one of the upper clamping portion 33U and the lower clamping portion 33D is omitted in the abutment member 30 according to Embodiment 1.

The present invention also encompasses a configuration in which one of the mounting portion 231U and the mounting portion 231D is omitted in the abutment member 230 according to Embodiment 2.

LIST OF REFERENCE NUMERALS

8 Structural body
2 Wall material (exterior wall plate)
2B Back surface of wall material (back surface of exterior wall plate)
2L, 2R Side end portion of wall material (2L: left side end portion of exterior wall plate, 2R: right side end portion of exterior wall plate)
10, 210, 310 Mounting member
11 Substrate portion
11A One side edge of substrate portion (lower edge of substrate portion)
11B Other side edge of substrate portion (upper edge of substrate portion)
12, 212 Wall portion
12A Leading edge of wall portion
13, 213, 313 Protruding portion
L13, L213 Length of protrusion of protruding portion from substrate portion
L12, L212 Length of protrusion of wall portion from substrate portion
14 Supporting portion
15 First locking portion
16 Second locking portion
30, 230 Abutment member
8P Substantially the same plane as substrate portion
31, 231U, 231D Mounting portion
32, 232U, 232D Erect piece
33, 233 Clamping portion
35, 235 First clamping portion
36, 236 Second clamping portion
T1 Plate thickness of protruding portion
W1 Gap between first clamping portion and second clamping portion
34, 234 Plate portion
12H Through hole
30B Fastening member (screw)
31H Fixing hole
11D Recess

The invention claimed is:

1. A mounting member that can be equipped with an abutment member, and that is used for mounting a wall material to a structural body, the mounting member comprising:

a substrate portion that can be fixed to the structural body;

a wall portion that protrudes from one side edge of the substrate portion relative to the substrate portion;

a protruding portion that protrudes from another side edge side of the substrate portion to the same side as the wall portion, and that has a length of protrusion from the substrate portion shorter than a length of protrusion of the wall portion from the substrate portion;

a supporting portion that approaches the protruding portion by extending from a leading edge of the wall portion so as to be opposed to the substrate portion;

a first locking portion that protrudes from the supporting portion toward a side opposite to the substrate portion, and that is bent to the wall portion side; and a second locking portion that protrudes from the supporting portion toward the side opposite to the substrate portion, and that is bent to the protruding portion side, wherein the abutment member includes a mounting portion that can be fixed onto at least one of the substrate portion and substantially the same plane as the substrate portion from the protruding portion side, an erect piece that is provided erecting in a direction intersecting the mounting portion, and that protrudes toward the side opposite to the substrate portion, and a clamping portion that is formed as a single piece with the mounting portion, and that is capable of clamping the protruding portion from a direction intersecting the substrate portion.

2. The mounting member according to claim 1, wherein the clamping portion includes a first clamping portion that is formed as a single piece with the mounting portion, and that can be abutted against the protruding portion, a second clamping portion that is capable of clamping, together with the first clamping portion, the protruding portion with a gap substantially equal to a plate thickness of the protruding portion provided between the first clamping portion and the second clamping portion, and a plate portion that connects the first clamping portion and the second clamping portion on a side opposite to the mounting portion, and that extends so as to be spaced apart from the mounting portion.

3. The mounting member according to claim 1, wherein the wall portion has a through hole.

4. The mounting member according to claim 1, wherein the wall portion is inclined so as to be spaced apart from the protruding portion in a direction from the substrate portion side toward the supporting portion side.

5. The mounting member according to claim 1, wherein the mounting portion of the abutment member has a fixing hole for fixing the mounting portion onto at least one of the substrate portion and substantially the same plane as the substrate portion, using a fastening member, the substrate portion includes a recess that is recessed to a side opposite to the supporting portion, and that extends parallel to the other side edge of the substrate portion, and the recess is disposed so as to pass through a center of the fixing hole in a state in which the clamping portion clamps the protruding portion and the mounting portion is opposed to the substrate portion.

6. A building wall structure to which a wall material is mounted to a structural body using a mounting member that can be equipped with an abutment member, wherein the mounting member includes a substrate portion that can be fixed to the structural body;

a wall portion that protrudes from one side edge of the substrate portion relative to the substrate portion;

a protruding portion that protrudes from another side edge side of the substrate portion to the same side as the wall portion, and that has a length of protrusion from the substrate portion shorter than a length of protrusion of the wall portion from the substrate portion;

a supporting portion that approaches the protruding portion by extending from a leading edge of the wall portion so as to be opposed to the substrate portion, and that is capable of supporting a back surface of the wall material;

a first locking portion that protrudes from the supporting portion toward a side opposite to the substrate portion, that is bent to the wall portion side, and that is capable of locking one end portion of the wall material; and a second locking portion that protrudes from the supporting portion toward the side opposite to the substrate portion, that is bent to the protruding portion side, and that is capable of locking another end portion of the wall material, and the abutment member includes a mounting portion that can be fixed onto at least one of the substrate portion and substantially the same plane as the substrate portion from the protruding portion side, an erect piece that is provided erecting in a direction intersecting the mounting portion, that protrudes toward the side opposite to the substrate portion, and that can be abutted against a side end portion of the wall material, and a clamping portion that is formed as a single piece with the mounting portion, and that is capable of clamping the protruding portion from a direction intersecting the substrate portion.

* * * * *